US010546562B1

(12) United States Patent
Baldevarona

(10) Patent No.: US 10,546,562 B1
(45) Date of Patent: Jan. 28, 2020

(54) ADJUSTABLE FEEDBACK CONTROL DEVICE FOR ACOUSTIC GUITAR

(71) Applicant: Joel Baldevarona, Bolingbrook, IL (US)

(72) Inventor: Joel Baldevarona, Bolingbrook, IL (US)

( * ) Notice: Subject to any disclaimer, the term of this patent is extended or adjusted under 35 U.S.C. 154(b) by 0 days.

(21) Appl. No.: 16/274,722

(22) Filed: Feb. 13, 2019

(51) Int. Cl.
*G10D 3/02* (2006.01)

(52) U.S. Cl.
CPC ..... *G10D 3/02* (2013.01)

(58) Field of Classification Search
CPC ..... G10D 3/02
See application file for complete search history.

(56) References Cited

U.S. PATENT DOCUMENTS 4,394,830 A 7/1983 Damiano
4,632,003 A 12/1986 Kopp
5,883,322 A 3/1999 Baker
6,681,661 B2 * 1/2004 Lalonde ..... G10D 3/02 84/267
9,646,581 B2 5/2017 Landis
9,899,017 B2 * 2/2018 Keeler ..... G10K 9/22

* cited by examiner

*Primary Examiner* — Robert W Horn
(74) *Attorney, Agent, or Firm* — Erickson Law Group, PC

(57) ABSTRACT

A sound hole cover for an amplified acoustic guitar includes a base plate having formations for releasably attaching the sound hole cover to the sound board of an acoustic guitar, over the sound hole. The base plate includes a solid sector and an open sector. The cover includes a cover plate having a closed sector and an open sector. The cover plate is pivotally connected at a central location to the base plate by a pin, rivet, screw or the like. The open sector of the cover plate can register with the open section of the base plate when the cover plate is rotated to a first position to provide a maximum opening through the sound hole and into the soundbox of the acoustic guitar. The open sector of the cover plate can be rotated into a second position out of registry with the open sector of the base plate to substantially close the sound hole. A handle or knob is connected to the cover plate. The knob has a supplemental air channel therein with an entry port in air communication with the soundbox and one or more exit ports to an outside of the soundbox. When the cover plate is rotated to the substantially closed position, the entry port is in air communication to an inside of the soundbox and the exit ports are open to the outside of the soundbox, to provide some sound to reach the guitarist to monitor his or her performance.

12 Claims, 7 Drawing Sheets

ADJUSTABLE FEEDBACK CONTROL DEVICE FOR ACOUSTIC GUITAR

BACKGROUND

An acoustic guitar has a hollow body forming a soundbox with a sound hole into the soundbox and a plurality of strings arranged over the sound hole. Some acoustic guitars are amplified by an external microphone, and some acoustic guitars include an electronic pickup device mounted within the soundbox.

For amplified hollow body guitars, acoustic feedback can be a problem. Acoustic feedback happens when an amplified soundwave from the guitar resonates a guitar front face or soundboard, and the guitar strings, which resonates within the hollow inside of the guitar body at certain frequencies. The resonating frequencies are amplified by the amplifier and when played through the loudspeakers in turn causes an increase in the resonating of the guitar in a feedback loop. The feedback loop cause an unpleasant buzz or hum sound.

To alleviate this problem, it is known to provide a cover over the sound hole which selectively reduces the open area of the sound hole to control acoustic feedback. The cover can be adjustable in that the open area of the sound hole can be effectively increased or reduced by manual manipulation.

U.S. Pat. No. 6,681,661 describes an adjustable cover member for the sound hole of a guitar. The cover enables complete or partial closure of the hole. The cover incorporates a base plate provided with two triangular openings. A circular adjustment plate is pivotally mounted on the base plate. The circular adjustment plate includes a pair of triangular openings of substantially the same size of the triangular openings in the base plate. When the triangular openings in the adjustment plate are rotated to register with the openings in the base plate, the openings provide a maximum open area through the sound hole. The plate can be manually rotated to selectively reduce the registration of the openings between the adjustment plate and the base plate to tailor the sound of the guitar and to reduce the interaction of the external loudspeakers and the sound waves resonating in the hollow body of the guitar. At one position the openings of the adjustment plate are completely out of registry with the openings in the base plate and the adjustment plate effectively closes the sound hole. U.S. Pat. No. 6,681,661 is herein incorporated by reference to the extent that it is not contrary to the present disclosure.

Other attempts at sound hole covers are disclosed in U.S. Pat. Nos. 4,394,830; 4,632,003; 5,883,322; and 9,646,581, all herein incorporated by reference to the extent that they are not contrary to the present disclosure.

The present inventor has recognized that if the sound hole cover is completely closed, acoustic feedback problems may be minimized or eliminated. However, this may create an unwanted side effect. If a guitarist is performing in front of a live audience, the amplified loudspeakers may be directed toward the audience and not toward the guitarist. The guitarist may not be able to hear his own playing to monitor his performance, particularly if other sounds on stage from other musical instruments overwhelms the unamplified acoustic sounds emanating from the guitar.

The present inventor has recognized the desirability of providing, for an amplified acoustic guitar with a soundbox and a sound hole, an adjustable closing device to reduce or eliminate unwanted acoustic feedback, while at the same time providing at least a small degree of sound to emanate from the sound hole.

The present inventor has recognized the desirability of an acoustic guitar having a sound hole closing device to prevent unwanted feedback but that also provides unamplified sound to the guitarist in an audible signal for stage-monitoring the guitarist's performance.

The present inventor has recognized the desirability of an acoustic guitar sound hole cover that was cost effectively manufactured, effective to prevent unwanted acoustic feedback, rugged in construction, and easily adjustable by the guitarist.

SUMMARY

The exemplary embodiments of the invention provide an improved sound hole cover for an amplified acoustic guitar. The sound hole cover includes a base plate having formations for releasably attaching the sound hole cover to the sound board of an acoustic guitar over the sound hole. The base plate includes a solid sector and an open sector. The cover includes a cover plate having a closed sector and an open sector. The cover plate is pivotally connected at a central location to the base plate by a pin, rivet, screw or the like. The open sector of the cover plate can register with the open section of the base plate when the cover plate is rotated to a first position to provide a maximum opening through the sound hole and into the hollow body or soundbox of the acoustic guitar. The open sector of the cover plate can be rotated into a second position out of registry with the open sector of the base plate to substantially close the sound hole.

By rotating the cover plate a selected degree between the first and second positions the degree of opening through the sound hole and into the soundbox can be selected. A handle or knob is connected to the cover plate. The knob has one or more supplemental air channels therein with an entry port in selective air communication with the soundbox and one or more exit ports to an outside of the soundbox. When the cover plate is rotated to the substantially closed second position, the entry port is in air communication to an inside of the soundbox. When the cover plate is rotated into the first position the entry port is closed off from the soundbox while the open sectors of the base plate and the cover plate are in air communication through the sound hole and the soundbox.

By providing the cover with the supplemental air channel that is open when the cover is otherwise substantially closed, the detrimental feedback loop is prevented or reduced while at the same time the supplemental air channel provides some sound to emanate from the soundbox to be heard by the guitarist. Thus, even is the amplified sound from the guitar is played by loudspeakers directed away from the guitarist and other instruments on stage with the guitarist interfere with the hearing of the guitarist, the supplemental air channel provides enough sound to the guitarist to monitor his playing.

Numerous other advantages and features of the present invention will be become readily apparent from the following detailed description of the invention and the embodiments thereof, and from the accompanying drawings.

DETAILED DESCRIPTION

Figure 1:
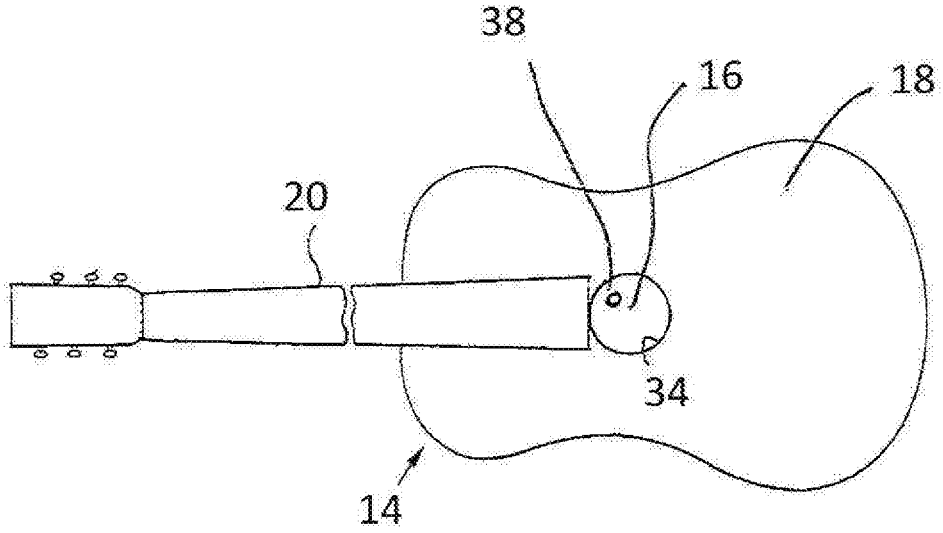
FIG. 1 PRIOR ART
FIG. 1 is a schematic illustration of a guitar of the prior art.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates schematically an acoustic guitar 10 of the prior art, such as described in U.S. Pat. No. 6,681,661, herein incorporated by reference. The guitar includes a hollow body 14, forming a soundbox 16, beneath a top wall or soundboard 18. The guitar includes a neck 20 extending from the soundbox and strings (not shown) over the neck which span between an end fret or nut (not shown) and a bridge (not shown). The strings span over the sound board 18 and over a sound hole 34 open through the sound board 18 and into the soundbox 16. For an acoustic instrument to make sound, the strings vibrate, transferring the vibration to the bridge which transfers the vibration into the sound board which vibrations are amplified in the soundbox. For an amplified acoustic guitar, sound pickups 38 can be located inside the soundbox. The pickups, like microphones, send an electronic signal to an external amplifier which amplifies the signal to drive loudspeakers.

As described in the Background, if the loudspeakers are sufficiently loud or close to the sound hole, an acoustic feedback loop can be created with the soundbox causing an aggravating hum or buzz.

FIGS. 2-13 illustrate a sound hole cover according to the invention.

Figure 2:
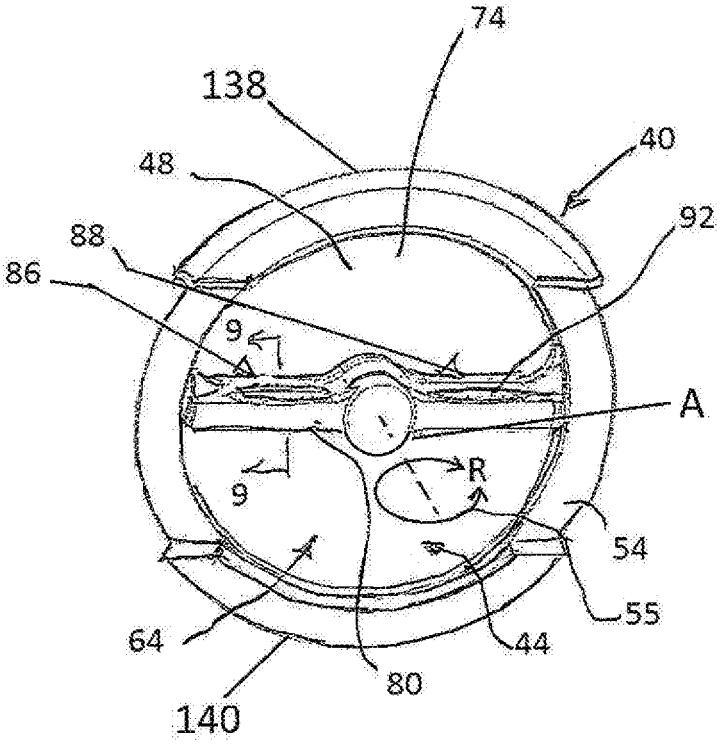
FIG. 2 is a front perspective view of a sound hole cover of the present invention in a closed configuration.

FIG. 2 illustrates the sound hole cover 40 to be installed in the sound hole, and supported by the soundboard. The sound hole cover 40 can be used to minimize the feedback loop between loudspeakers and the sound hole.

The cover 40 is round to match the round perimeter of the sound hole and sized to resiliently snap partially into the sound hole with little or no circular gap between the edge of the sound hole and the perimeter of the cover.

The cover includes a base plate 44 and a cover plate 48, the cover plate 48 pivotally connected to the base plate by a pin, rivet, or screw 52 or the like and a washer 53, to rotate in the direction R about an axis A of the pin, rivet, screw or the like. The base plate 44 comprises an annular body 54, which can be of a resilient material such as being composed of rubber, and a substantially semi-circular plate 55, such as a plastic plate, fixed into the annular body 54, together forming a substantially semi-circular open sector 60 and a substantially semi-circular closed sector 64. Alternate to a plate 55, the substantially semicircular closed sector 64 can be the same material as the annular body and formed unitary therewith. The cover plate 48 includes a circular body with a substantially semi-circular open sector 68 being an opening through the circular body, and a substantially semi-circular closed sector 74. The cover plate can be composed of plastic or other suitable material. The open sectors 60, 68 can be of substantially the same open area and shape.

Figure 3:
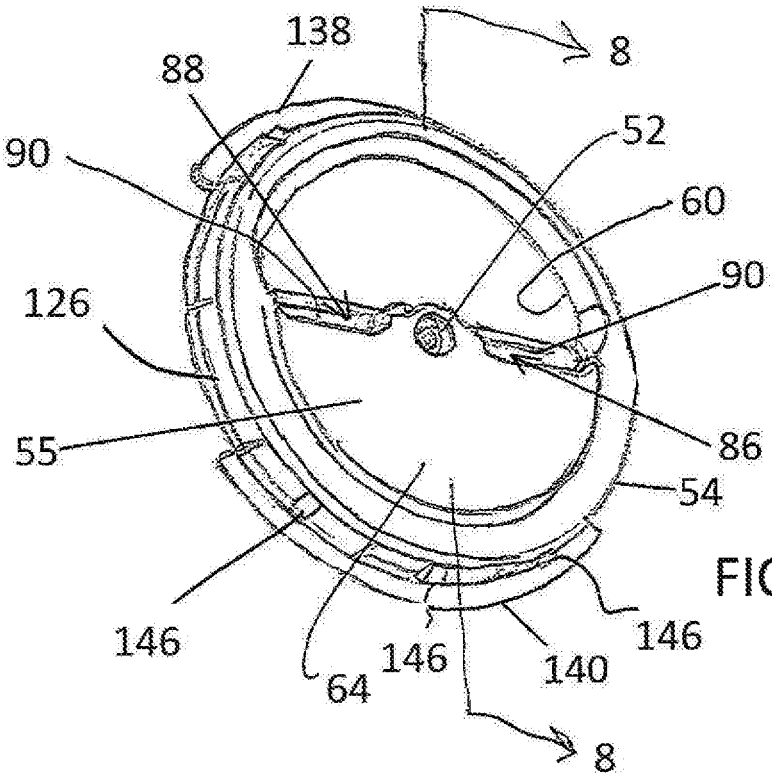
FIG. 3 is rear perspective view of the sound hole cover of FIG. 2.
Figure 4:
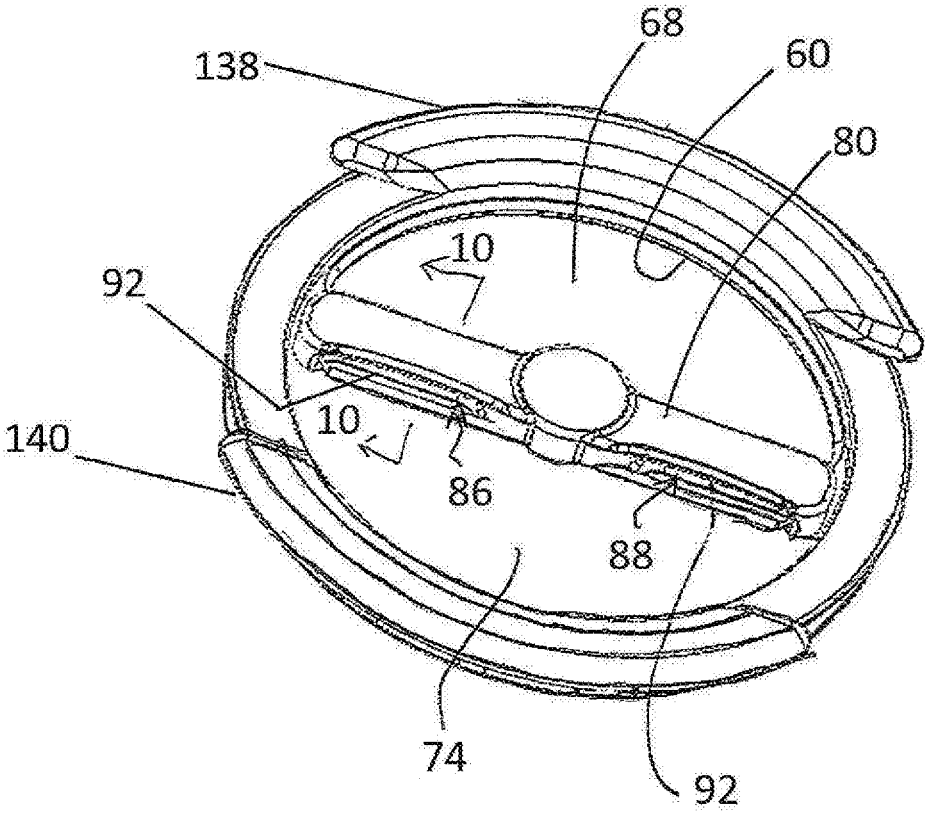
FIG. 4 is a front perspective view of the sound hole cover of FIG. 2 in an open configuration taken from below.
Figure 5:
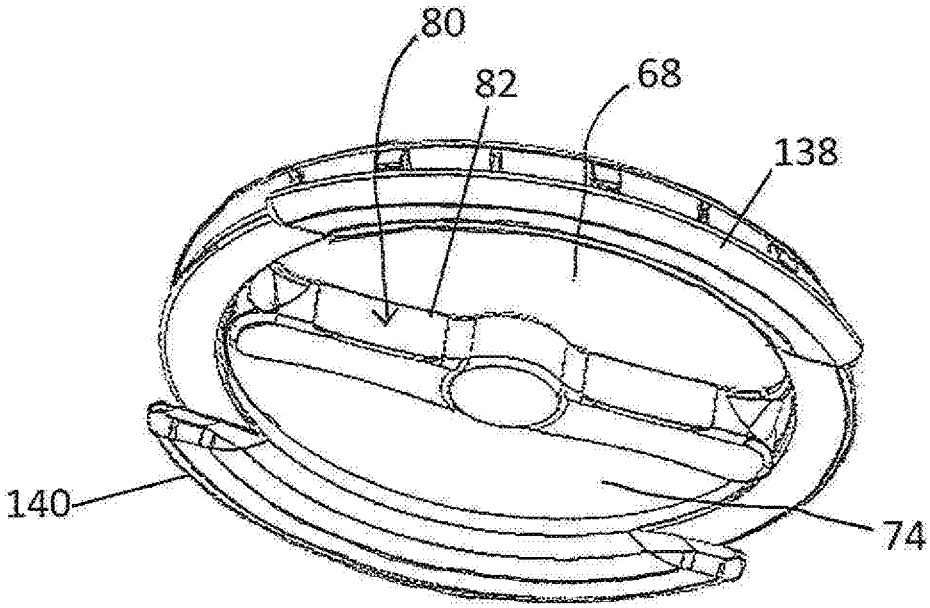
FIG. 5 is a front perspective view of the sound hole cover of FIG. 2 in an open configuration taken from above.
Figure 6:
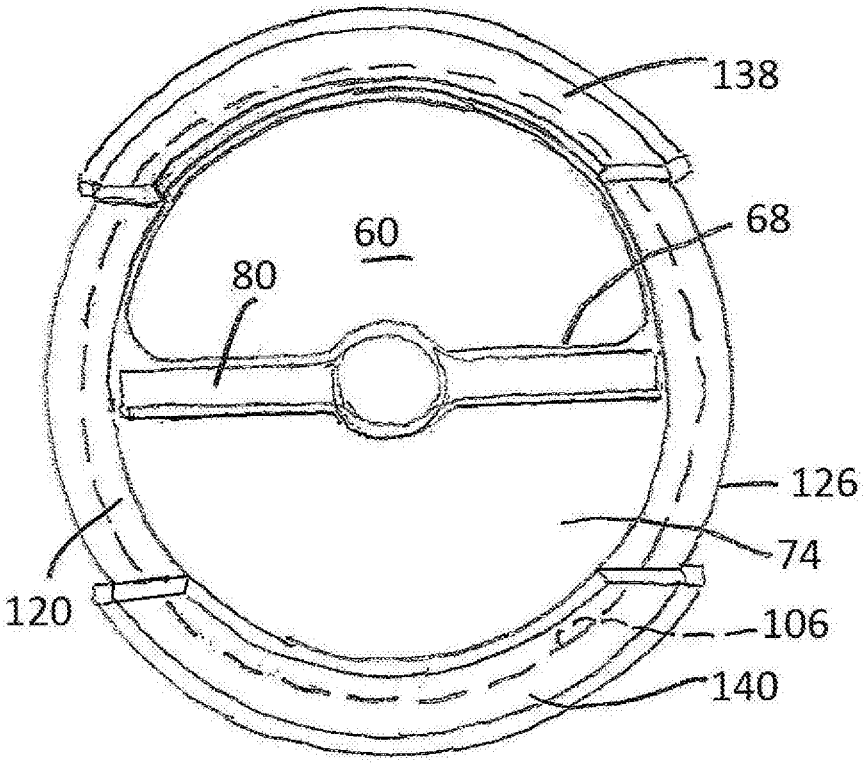
FIG. 6 is a front view of the sound hole cover of FIG. 2 in an open configuration.
Figure 7:
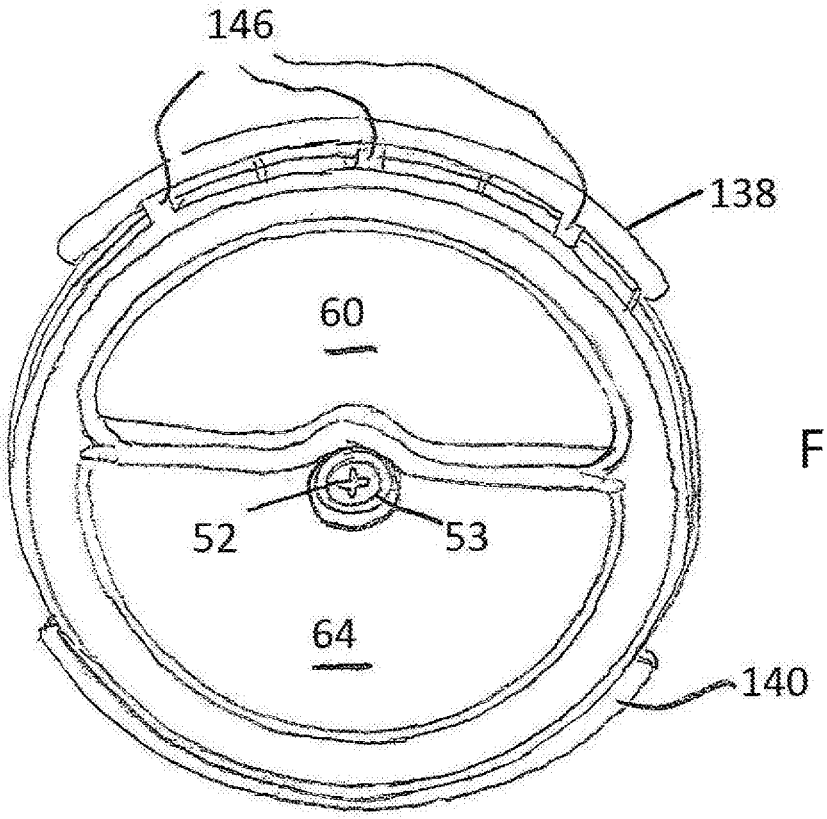
FIG. 7 a rear view of the sound hole cover of FIG. 2 in an open configuration.
Figure 8:
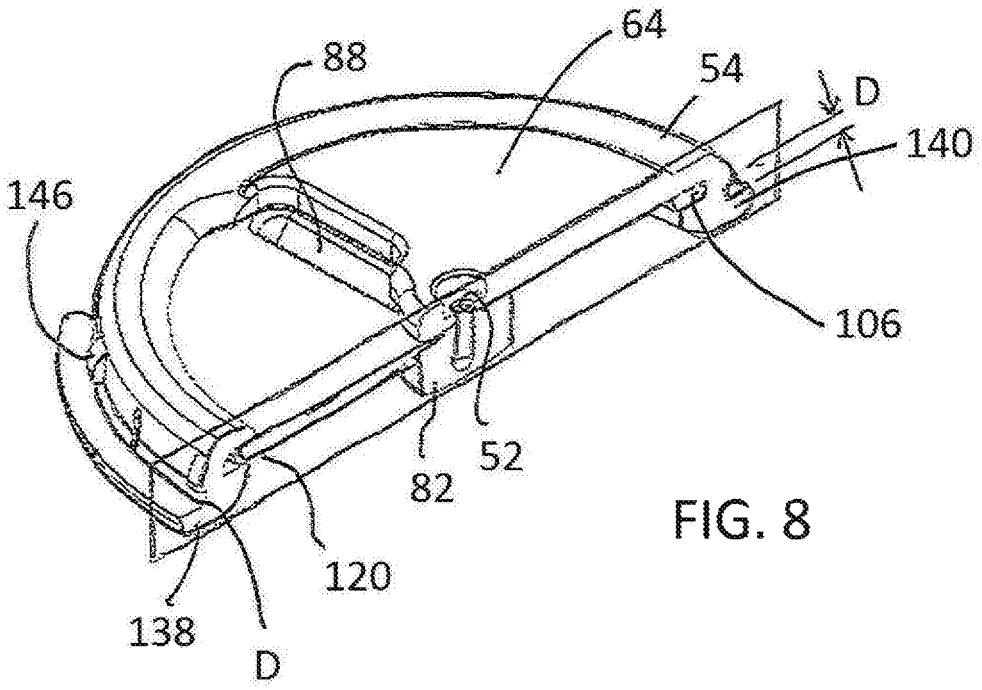
FIG. 8 is a sectional view taken generally along lines 8-8 in FIG. 3.

As shown in FIGS. 2-3, when the plates 44, 48 are relatively rotated into a closed configuration, the open sector 60 of the base plate 44 is in registry with the closed sector 74 of the cover plate 48 and the open sector 68 of the cover plate 48 is in registry with the closed sector 64 of the base plate 44. The cover 40 substantially closes the air path between the sound box and the outside.

As shown in FIGS. 4-7, when the plates 44, 48 are relatively rotated into an open configuration, the open sectors 60, 68 are in registry and form a large air path through the sound hole cover and into the soundbox when installed.

By relatively rotating the cover plate 48 with respect to the base plate 44 at intermediate positions between the open and closed positions, different degrees of registry between the open sectors 60, 68 can be selected to change the size of the opening through the soundboard. This function not only can be used to prevent acoustic feedback but can also be used to tailor the sound from the guitar.

The exemplary embodiment provides a supplemental path for some sounds from the soundbox to reach the guitar player.

Figure 9:
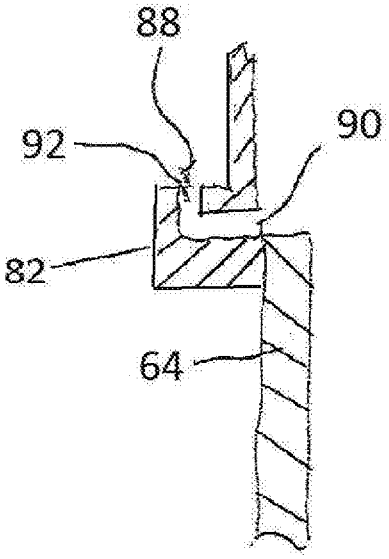
FIG. 9 is a sectional view taken generally along line 9-9 of FIG. 2.
Figure 10:
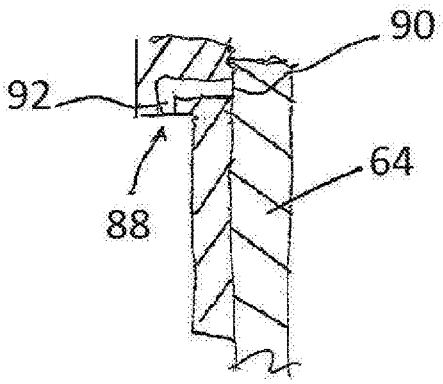
FIG. 10 is a sectional view taken generally along line 10-10 of FIG. 4.
Figure 11:
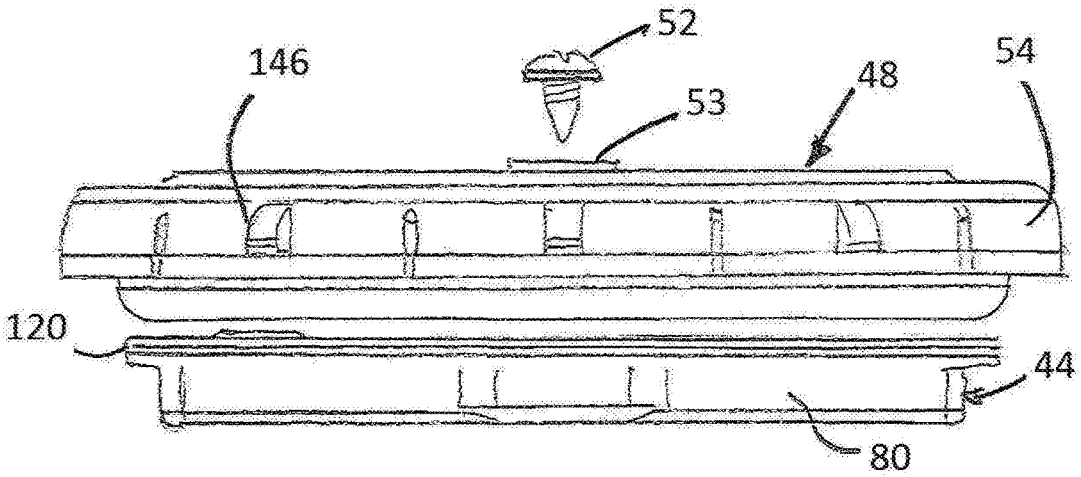
FIG. 11 is an exploded side view of the sound hole cover of FIG. 2.
Figure 12:
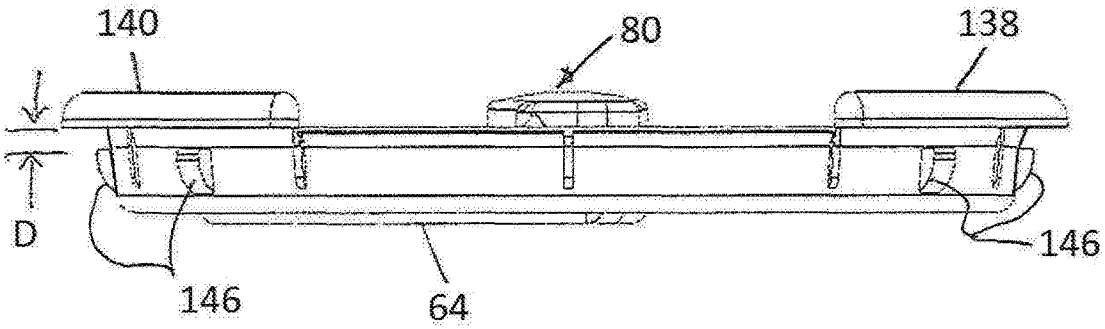
FIG. 12 is a side view of the sound hole cover of FIG. 2.

A knob or handle 80 is mounted onto the cover plate 48. The handle includes a bar portion 82. The bar portion 82 includes at least one and preferably two air channels 86, 88 between the soundbox and the outside of the soundbox. The air channels can be L-shaped. Each air channel includes an entry port 90 at a base thereof. The channel extends though the bar portion to an exit port 92, open to the outside of the soundbox. When the cover plate 48 is rotated into the closed position, as shown in FIGS. 2, 3 and 9, the entry ports 90 are open into the open sector 60 of the base plate 44, which opens the air channels 86, 88. Thus, even though the sound hole cover 40 is substantially closed, the air channels 86, 88 provide some sound to emanate from the soundbox so the guitarist can monitor his playing, notwithstanding the position and direction of the amplified loudspeakers. According to the exemplary embodiment, the exit ports 92 in the closed configuration of the cover 40 are directed upward toward the head and ears of the guitar player.

When the cover plate 48 is rotated into the open configuration per FIGS. 4-7, and 10, the entry ports 90 are covered by the closed sector 64, effectively closing the channels 86, 88. The entry ports 90 are along a line that is offset from the axis of rotation of the bar portion 82 so that the entry ports are uncovered in the closed configuration of the cover plate 48 and, after the bar portion 82 is rotated 180 degrees, into the open configuration of the cover plate 48, are covered by the closed sector 64 of the base plate.

According to the exemplary embodiment, the base plate resilient annular body 54 includes an inward facing, circumferential groove or channel 106. The cover plate comprises an annular edge portion 120 of the circular body (see FIG. 13) that fits within the circumferential channel 106, which guides the relative rotary movement between the cover plate and the base plate.

The base plate 44 has a perimeter 126 that is slightly smaller in diameter 128 to the sound hole such as to be snugly fitted into the hole. Alternately, the base plate perimeter is equal to, or slightly greater in diameter to the diameter of the sound hole and is resiliently compressed to fit into the sound hole. The base plate also includes an upper flange 138 and a lower flange 140 which extend out past the base plate perimeter 126 and prevent the base plate from passing through the sound hole and entering the soundbox of the guitar. Beneath the flanges, and arranged spaced apart circumferentially and extending radially from the perimeter, are tapered nubs 146 (see FIGS. 8, 11 and 12). The tapered nubs are spaced from the adjacent flange 138, 140 by a distance D slightly smaller than a thickness of the sound board of the guitar (see FIGS. 8 and 12). Thus, when the cover 40 is pushed into the sound hole, upper and lower rim areas 160, 162 of the sound board adjacent the sound hole are gripped between the flanges 138, 140 and the tapered nubs 146. The tapered nubs are tapered in a direction toward the sound hole to allow the base plate perimeter 126 to be slightly compressed across the sound hole to allow entry of the nubs into the sound hole and spring back under the sound board.

Figure 13:
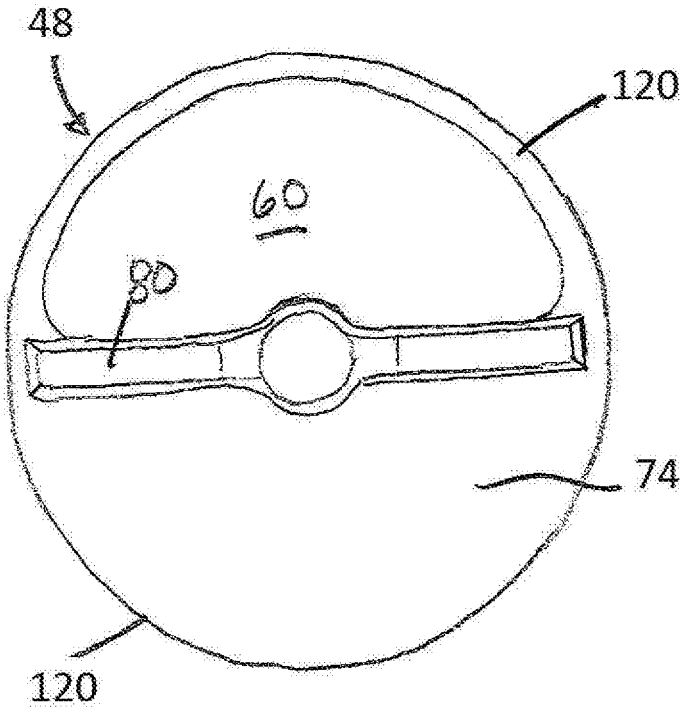
FIG. 13 is a front view of a portion of FIG. 2.

FIG. 13 illustrates the cover plate 44 removed from the base plate 48. As can be seen the cover plate is circular with the annular portion 120 for being rotationally guided in the groove or channel 106 of the base plate 48. The opening 60 is partially defined by the annular portion 120.

Although the exemplary embodiment provides that the supplementary air channel is formed into the knob or handle, it could also be formed as a separate path through the base plate and cover plate, not associated with the knob or handle.

Although the exemplary embodiment describes use of the cover with an amplified acoustic guitar, it could also be applicable to other hollow body string instruments. Although the exemplary embodiment describes use of the cover with an amplified acoustic guitar, it could also be applicable to an acoustic instrument that is amplified by an external microphone.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, to the extent that the references are not contrary to the present disclosure.

The invention claimed is:

1. A sound hole cover for an acoustic stringed instrument, comprising;

a base plate having an base open sector and a base closed sector;

a cover plate, the cover having an cover open sector and a cover closed sector;

wherein the cover plate is rotationally connected to, and over, the base plate, and wherein the cover plate is rotational between a first position where the base open sector is in registry with the cover open sector, which creates an open air path through the cover plate and the base plate, and a second position where the base open sector is in registry with the cover closed sector and the cover open sector is in registry with the base closed sector, substantially closing an air path through the base plate and the cover plate; and a supplemental air path through the base plate and the cover plate when the cover plate is in the second position, the supplemental air path having a reduced air flow capacity compared to the open air path through the base and cover open sectors when in the first position.

2. The sound hole cover of claim 1, wherein the supplemental air path is directed in part toward the head of the person playing the acoustic instrument.

3. The sound hole cover of claim 1, wherein the cover plate includes a handle, and the supplemental air path is formed through the handle.

4. The sound hole cover of claim 3, wherein the supplemental air path is L-shaped.

5. The sound hole cover of claim 3, wherein the supplemental air path comprises two L-shaped air paths.

6. The sound hole cover of claim 1, wherein the supplemental air path comprises two air paths.

7. The sound hole cover of claim 1, wherein the base plate has a circumferential groove and the cover plate has an annular outer portion that fits into the groove, the groove guiding rotational movement of the cover plate with respect to the base plate.

8. The sound hole cover of claim 7, wherein the cover plate has a bar protruding from the predominant front surface of the cover plate, the bar for turning the cover plate with respect to the base plate.

9. The sound hole cover of claim 8, wherein the supplemental air channel is formed though the bar with an outlet directing sound in a direction that is 90 degrees to the predominant front surface of the cover plate.

10. The sound hole cover of claim 9, wherein the supplemental sir channel comprises two L-shaped air passages through the bar.

11. The sound hole cover of claim 10, wherein the base plate has an annular perimeter portion that is composed of a resilient material.

12. The sound hole cover of claim 11, wherein the annular perimeter portion includes upper and lower flanges that prevent the base plate from falling through the sound hole and tapered nubs spaced rearward from the flanges and arranged to grip a guitar soundboard between the flanges and the nubs when the sound hole cover is installed into the sound hole of a guitar.

* * * * *